US007230218B2

(12) United States Patent
Roussy

(10) Patent No.: US 7,230,218 B2
(45) Date of Patent: Jun. 12, 2007

(54) MICROWAVE OR RADIO FREQUENCY DEVICE INCLUDING THREE DECOUPLED GENERATORS

(75) Inventor: Georges Roussy, Laxou (FR)

(73) Assignee: RIMM Technologies Corporation N.V., Curacao (NL)

( * ) Notice: Subject to any disclaimer, the term of this patent is extended or adjusted under 35 U.S.C. 154(b) by 0 days.

(21) Appl. No.: 10/553,322

(22) PCT Filed: Apr. 15, 2004

(86) PCT No.: PCT/IB2004/001274

§ 371 (c)(1),
(2), (4) Date: Aug. 17, 2006

(87) PCT Pub. No.: WO2004/093499

PCT Pub. Date: Oct. 28, 2004

(65) Prior Publication Data

US 2007/0075072 A1 Apr. 5, 2007

(30) Foreign Application Priority Data

Apr. 16, 2003 (FR) ..... 03 04727

(51) Int. Cl.
*H05B 6/70* (2006.01)
*H05B 6/80* (2006.01)

(52) U.S. Cl. ..... 219/697; 219/717; 219/746; 333/230

(58) Field of Classification Search ..... 219/695–697, 219/717, 746, 748; 333/230
See application file for complete search history.

(56) References Cited

U.S. PATENT DOCUMENTS 4,323,745 A * 4/1982 Berggren ..... 219/697
RE31,241 E 5/1983 Klaila
4,908,486 A * 3/1990 Fry ..... 219/697
4,952,763 A * 8/1990 Fritz ..... 219/697
5,449,889 A 9/1995 Samardzija
6,104,018 A * 8/2000 Varma et al. ..... 219/746

FOREIGN PATENT DOCUMENTS

| | | |
|---|---|---|
| DE | 201 11 269 | 2/2002 |
| EP | 1 018 856 A | 7/2000 |
| EP | 1 196 010 A | 4/2002 |
| JP | 62 222595 A | 9/1987 |

* cited by examiner

*Primary Examiner*—Philip H. Leung
(74) *Attorney, Agent, or Firm*—Westerman, Hattori, Daniels & Adrian, LLP.

(57) ABSTRACT

A microwave or radio frequency device including an applicator for receiving an object to be processed, and a plurality of generators supplying power to the applicator via propagation guides. According to the invention, three propagation guides propagating the microwaves or radio frequencies generated by three respective generators are mounted on three respective plates defining a three-dimensional rectangular axis system, and symmetrical relative to a ternary axis of symmetry of the axis system, whereby the generators supplying power to the applicator are mutually decoupled. The three propagation guides have a rectangular cross-section and are mounted on respective plates in such a way that the short sides of the rectangular cross-section of said guides are orthogonal in pairs, or are coaxial cables extending in a longitudinal propagation direction perpendicular to the plates with one exposed end thereof extending into the applicator. The position of the propagation guides is variable depending on rotation thereof about the longitudinal propagation direction, and translation in a direction parallel to the plates on which they are mounted.

13 Claims, 10 Drawing Sheets

MICROWAVE OR RADIO FREQUENCY DEVICE INCLUDING THREE DECOUPLED GENERATORS

The invention relates to a microwave or radiofrequency device.

At the present time, it is important to design microwave devices to produce uniform and very intense electromagnetic field distributions.

The multimode resonant cavity solution is unsatisfactory from the industrial standpoint because it applies to small volumes, for example of the order of one liter of product. For large volumes to be treated in industry, it is often necessary to have a total power of greater than a few kW, but the design of a uniform electromagnetic distribution with such a source then poses a serious problem.

The invention relates more particularly to a microwave or radiofrequency device comprising an applicator designed to house a product to be treated and several generators supplying power to the applicator via propagation guides.

A device of this type is known from the European patent application published on Jul. 12, 2000 under the number EP 1 018 856. Two generators supply power to the applicator via a magic Tee. The uniformity of the electric field in the applicator is obtained by a combination of electric field distributions produced by the two generators operating so as to be mutually decoupled, that is to say without one outputting into the other. The decoupling is obtained by the magic Tee and by the symmetry of the object to be irradiated with respect to the mid-plane. However, the supply for this type of device is limited to two generators.

It is an object of the invention to modify a microwave or radiofrequency device of the abovementioned type in order to increase the total irradiation power of the device while maintaining a uniform electromagnetic field distribution in the applicator.

For this purpose, the subject of the invention is a microwave or radiofrequency device comprising an applicator designed to house a product to be treated and several generators supplying power to the applicator via propagation guides, characterized in that three propagation guides propagating the microwaves or radiofrequency waves generated respectively by three generators are mounted respectively on three plates forming a three-axis orthogonal coordinate system and are arranged symmetrically with respect to the ternary axis of symmetry of the coordinate system so that the generators supply power to the applicator while being mutually decoupled.

The decoupling of the generators is explained by the electric image theory. The electromagnetic field produced by a source, lying above a perfectly conducting indeterminate plane, can be calculated by adding, to the electromagnetic field produced by the source, that produced by the image that is symmetrical with the source with respect to the metallic plane.

The three propagation guides of the device according to the invention are arranged symmetrically on the three faces of the three-axis orthogonal coordinate system referenced OX, OY, OZ in order to merge in the applicator so as to propagate an electric field parallel to the OX axis, parallel to the OY axis and parallel to the OZ axis, respectively. The images of the propagation guide lying in the XOY plane, with respect to the YOZ and ZOX planes, all lie in the same XOY plane with electric fields parallel to OX. In addition, there images emit electric field distributions whose polarization is parallel to OX, that is to say perpendicular to the polarization of the electric field of the distributions emitted by the other two generators. Whether the applicator is empty or occupied by a homogeneous object, the three generators are thus decoupled.

The decoupling of the three generators allows very uniform irradiation of the object to be treated by the applicator, with three separate electromagnetic field distributions that add together. The total power delivered by the generators is thus three times that delivered by each of them. It is possible for example to irradiate an object with a total power of 2.7 kW using three generators each of 900 W power. From an economic standpoint, if each generator costs 50 euros, 2.7 kW of power is thus obtained for 150 euros. In addition, the fact of using three low-power generators dispenses with the use of circulators, which are necessary when high-power generators are used.

In this invention, each magnetron may be supplied with power by each of the three phases of the three-phase supply mains, so that the power supply for an applicator remains balanced.

Other advantages of the invention will become apparent on reading the description of four embodiments illustrated by the drawings.

Figure 1:
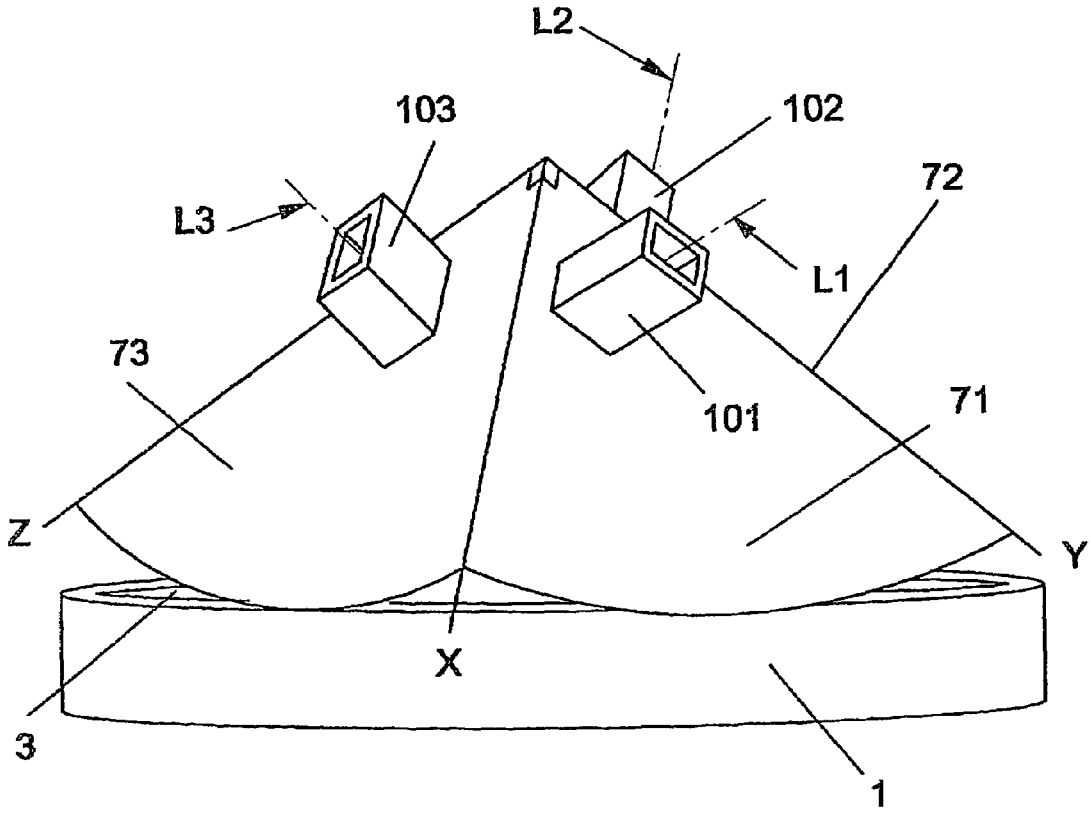
FIG. 1 shows schematically a microwave device according to a first embodiment of the invention.
Figure 2:
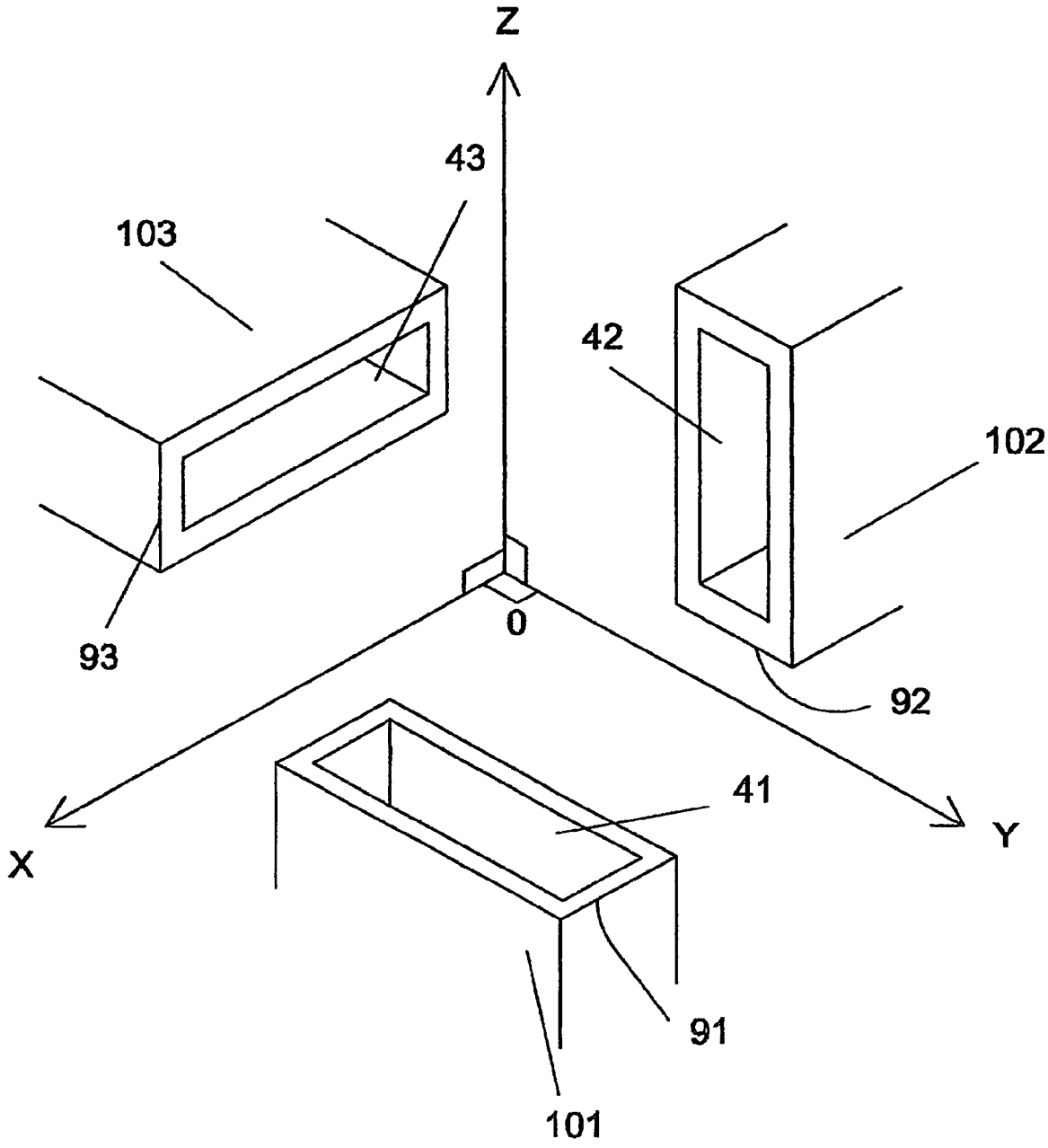
FIG. 2 is a view showing the principle of three propagation guides of rectangular cross section placed orthogonally to the faces of the coordinate system according to the first embodiment illustrated by FIG. 1.

FIGS. 1 and 2 show a microwave device according to a first embodiment of the invention, this comprising an applicator 1 designed to house an object 3 to be treated, for example a liquid, and three generators (not shown) supplying power to the applicator 1 via three propagation guides 101, 102 and 103. The latter propagate the microwaves generated by the three respective generators by being mounted respectively on three plates 71, 72 and 73 that form a three-axis orthogonal coordinate system defined by the OX, OY and OZ axes. The three propagation guides 101, 102 and 103 are arranged symmetrically with respect to the ternary axis of symmetry Δ of the coordinate system. In addition, each propagation guide 101, 102 or 103 extends along a longitudinal propagation direction L1, L2 or L3 perpendicular to the plate 71, 72 or 73 on which it is mounted.

In this first embodiment, the three propagation guides 101, 102 and 103 are of rectangular cross section and mounted respectively on the three plates 71, 72 and 73 so that the short sides 91, 92 and 93 of their rectangular cross section remain pairwise orthogonal. Thus, as illustrated by FIG. 2, the electric field vectors, oriented parallel to the short sides 91, 92 and 93 of the rectangular cross section, are mutually orthogonal. This arrangement allows the three generators to supply power to the applicator 1 while being mutually decoupled.

The three propagation guides 101, 102 and 103 emerge in the applicator 1 via microwave-transparent windows 41, 42 and 43 that are formed at one end of each guide, in correspondence with openings formed in the plates 71, 72 and 73 on which they are mounted. The three-axis orthogonal coordinate system is placed above the applicator 1 along the ternary axis of symmetry Δ of the coordinate system. The product 3 to be treated may be recovered via a bottom pipe.

It should be noted that the presence of the liquid in the applicator shifts the electric images of the generators with respect to the free surface of the liquid by an amount in relation to the permittivity of the liquid. It follows that the three generators remain decoupled even as regards the waves reflected by the free surface of the liquid.

As a consequence of decoupling the three generators, the energy distribution applied to the object to be treated is the sum of the squares of the components of the electric fields generated by each generator. From this it follows that the contribution by each generator to the total power of the device is the largest possible.

Figure 3:
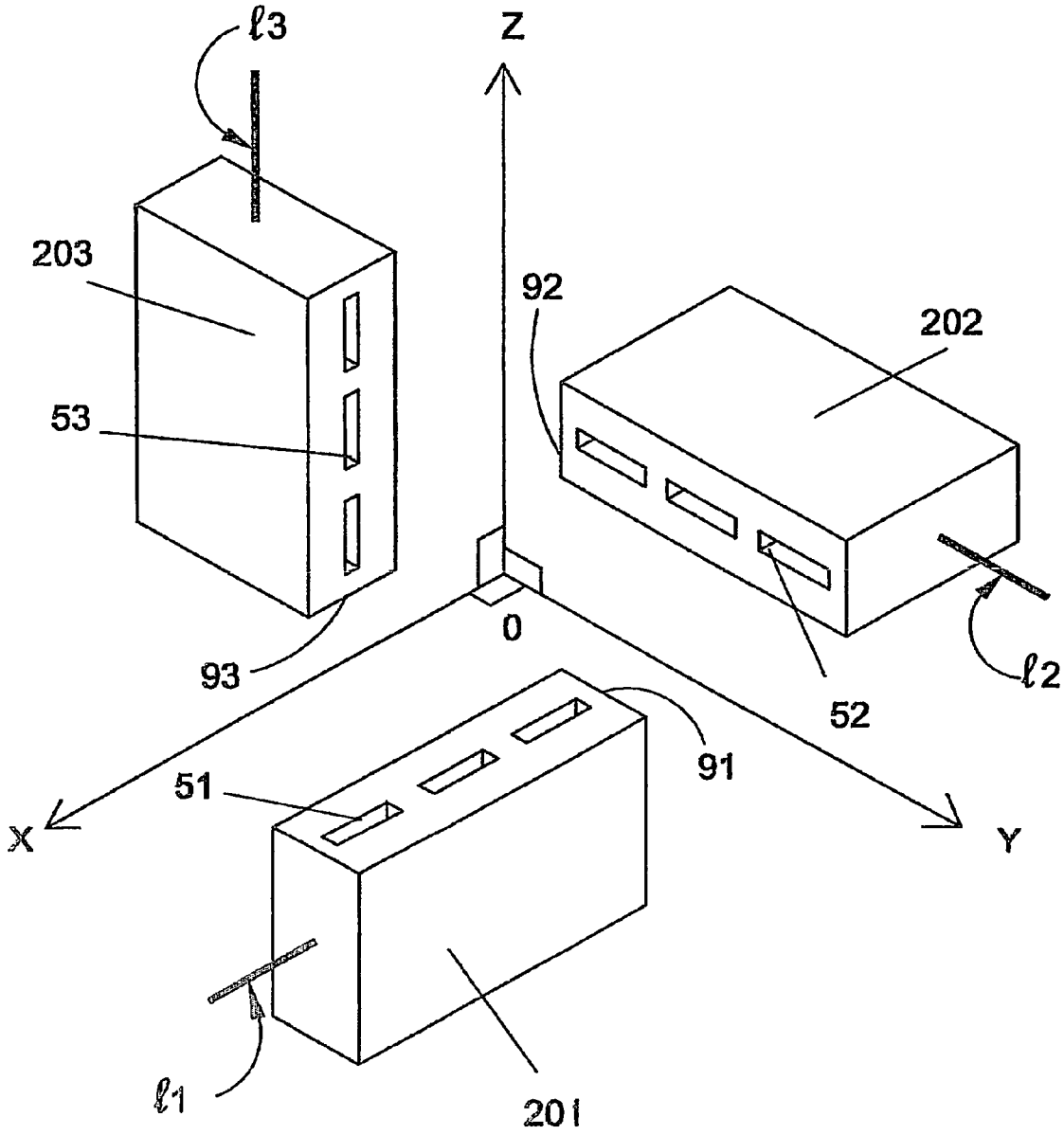
FIG. 3 is a view showing the principle of three propagation guides of rectangular cross section that are placed parallel to the faces of the coordinate system according to a second embodiment.

FIG. 3 shows a second embodiment of the invention, which differs from the previous one in that each propagation guide 201, 202 and 203 extends along a longitudinal propagation direction l1, l2–l3 parallel to the plate 71, 72 or 73 on which it is mounted. The three propagation guides 201, 202 and 203 are arranged symmetrically with respect to the ternary axis of symmetry Δ of the coordinate system.

In this second embodiment, the three propagation guides 201, 202 and 203 are also of rectangular cross section mounted respectively on the three plates 71, 72 and 73 so that the short sides 91, 92 and 93 of their rectangular cross sections remain pairwise orthogonal.

Here again, this arrangement allows the three generators to supply power to the applicator 1 while being mutually decoupled.

The three propagation guides 201, 202 and 203 emerge in the applicator via slots 51, 52 and 53 that are formed in the short side of each propagation guide, in correspondence with openings formed in the plates 71, 72 and 73 on which they are mounted.

The slots are machined in the short side of the propagation guides so has to have a length equal to λg/4 and to be distant from a short circuit located at the end wall of the guide by (1+2n)λg/4, where λg is the propagation wavelength in the supply guides of rectangular cross section. As an example, at a frequency of 2450 MHz, λg is equal to 173 mm for a propagation guide of cross section defined by a short side of 43 mm and a long side of 86 mm. It follows that the electromagnetic field distribution is more uniform than that obtained with the transparent-window propagation guides, such as those used in the first embodiment. Moreover, the energy density existing near the slots can be adjusted as required, so as not to exceed a critical value and to prevent the presence of an arc when it is desired to increase the power of the generators.

Figure 4A:
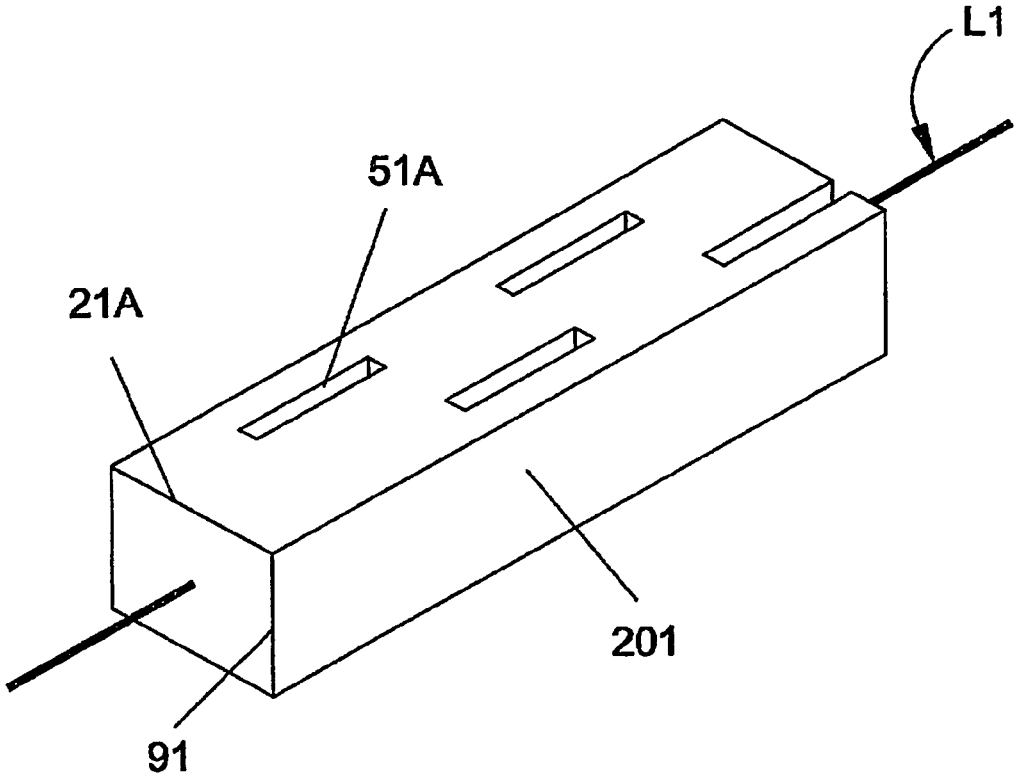
FIGS. 4A and 4B show schematically a propagation guide of rectangular cross section that has slots formed in the long side of the propagation guide.
Figure 4B:
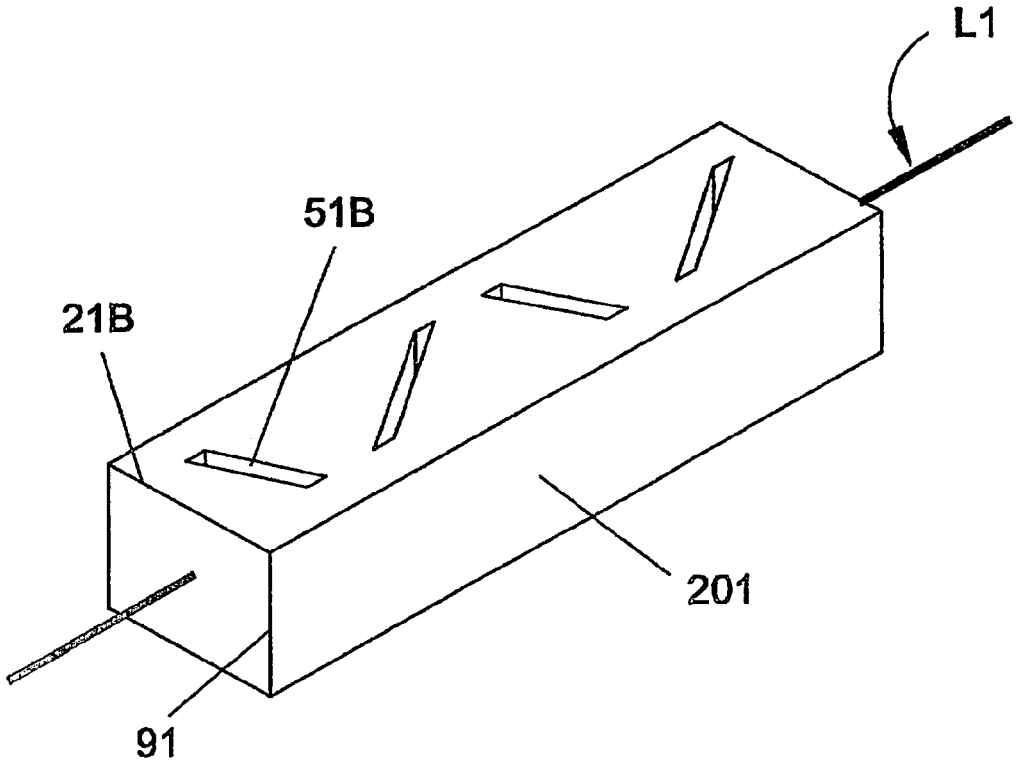

The invention provides for the slots to be formed in the long side of the propagation guides of rectangular cross section. In FIG. 4A, slots 51A, 52A or 53A are machined in the long side 21A, 22A or 23A of the propagation guides 201–203 along the longitudinal propagation direction L1–L3 so as to have a distance between two successive slots of λg/2 and so as to be at a distance from a short circuit located at the end wall of the guide by (1+2n)λg/4. In FIG. 4B, slots 51B, 52B or 53B are machined in the long side 21B, 22B, 23B of the propagation guides 201–203 so as to have a distance between two successive slots equal to λg/2 and to be distant from a short circuit located at the end wall of the guide by nλg/2. The angle of the slots relative to the longitudinal propagation direction of the guides depends on the number of slots machined in a guide. The reader should refer for example to the following publication: A. F. Harvey, "Microwave Engineering", Academic Press (1963), pages 634–636 and in particular to the references 332 and 457 cited on pages 690 and 694 respectively.

Figure 5:
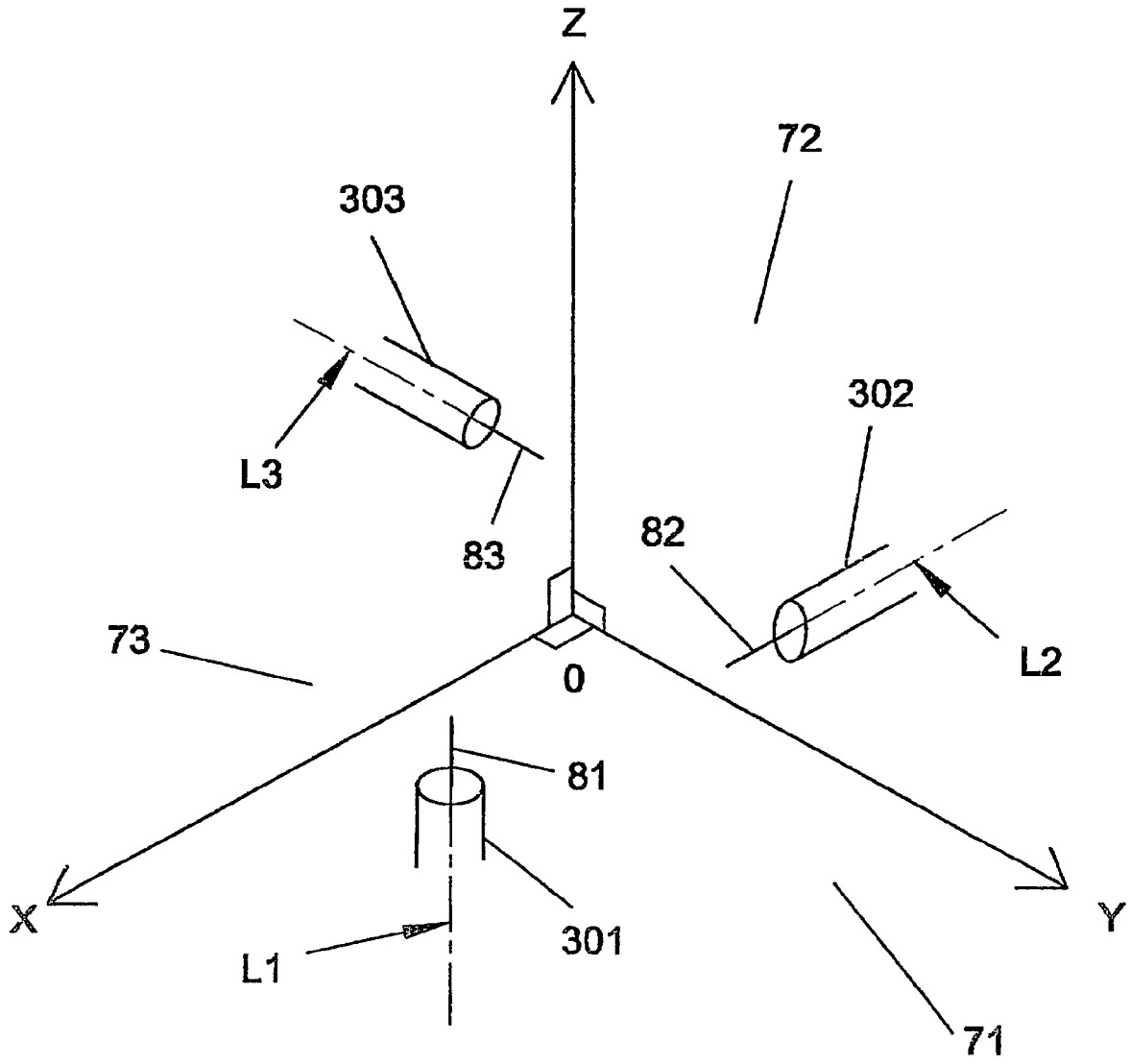
FIG. 5 is a view showing the principle of three propagation guides of a radiofrequency device, in the form of coaxial cables that are placed orthogonally to the faces of the coordinate system according to a third embodiment of the invention.

FIG. 5 shows a third embodiment of the invention, which is distinguished from the first or the second embodiment in that the three propagation guides 301, 302 and 303 are coaxial cables that extend along a longitudinal propagation direction L1, L2 and L3 perpendicular to the plates 71, 72 and 73 and emerge in the applicator via one of their stripped ends 81, 82 and 83. The three propagation guides 301, 302 and 303 are arranged symmetrically with respect to the ternary axis of symmetry Δ of the coordinate system. The electric field vectors oriented parallel to the cables 301, 302 are mutually orthogonal. Here again, this arrangement allows the three generators to supply power to the applicator while being mutually decoupled.

Figure 6:
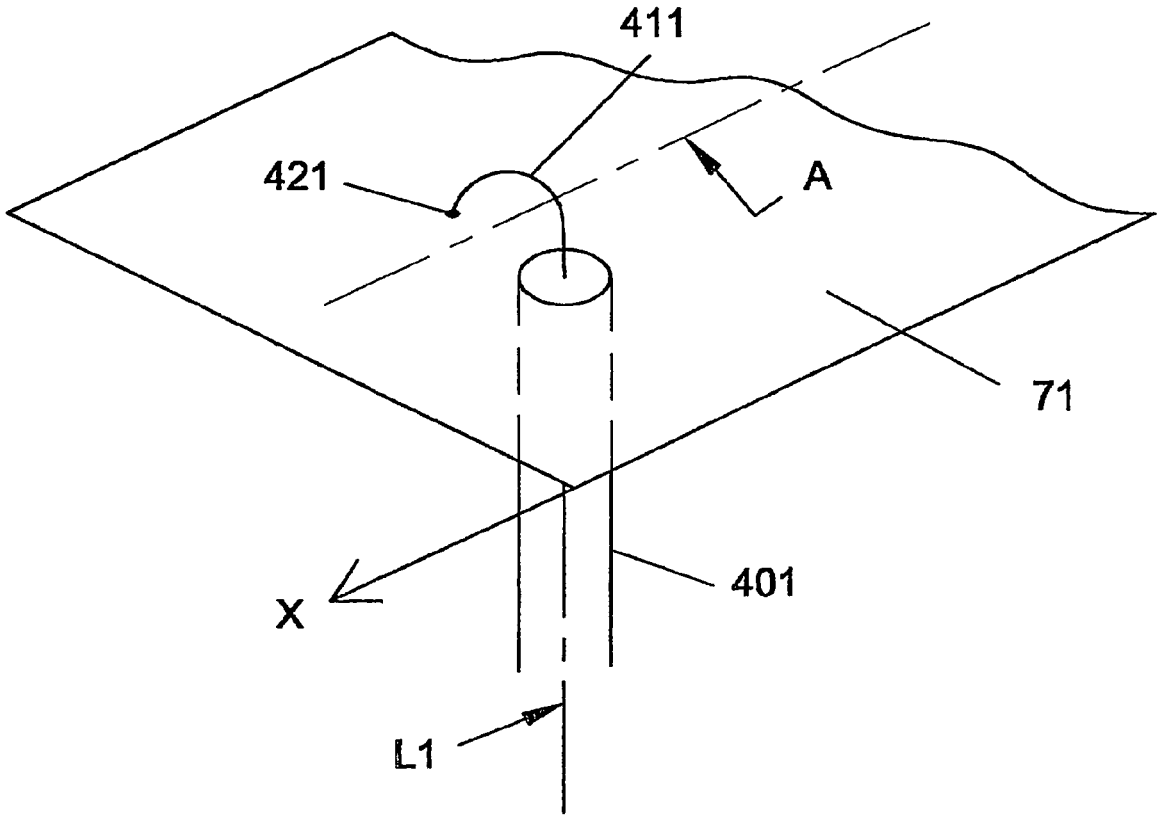
FIG. 6 is a view showing the principle of a propagation guide for a radiofrequency device in the form of a current loop lying in a plane perpendicular to the faces of the coordinate system according to a fourth embodiment of the invention.

FIG. 6 shows a fourth embodiment of the invention, which is distinguished from the third embodiment in that the three propagation guides 401, 402 and 403 are coaxial cables terminated by current loops 411, 412 and 413. The three propagation guides 401, 402 and 403 extend along a longitudinal propagation direction L1, L2 and L3 perpendicular to the plates 71, 72 and 73 and emerge in the applicator via a current loop 411, 412 and 413, a stripped end 421, 422 and 423 of which is fastened to the corresponding plate of the three-axis orthogonal coordinate system. The three propagation guides 401, 402 and 403 are arranged symmetrically with respect to the ternary axis of symmetry Δ of the coordinate system. The vectors of the magnetic field induced by the current loops are oriented along the axis A perpendicular to the plane of each current loop so as to remain mutually orthogonal. Here again, this arrangement allows the three generators to supply power to the applicator while being mutually decoupled.

Advantageously, for each of the embodiments above, the propagation guides 101–103, 201–203 or 301–303 occupy a variable position through a rotation about their longitudinal propagation direction and a translation parallel to the plates 71–73 on which they are mounted, while still preserving the symmetry with respect to the ternary axis of symmetry Δ of the three-axis orthogonal coordinate system defined by OX, OY, OZ in order to adjust the decoupling of the generators according to the shape of the object housed in the applicator 1.

Figure 8A:
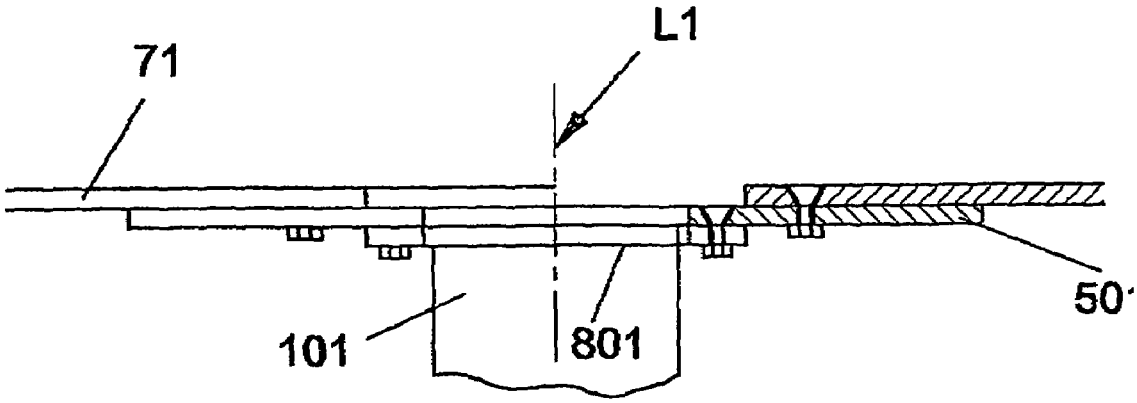
FIGS. 8A and 8B show schematically a propagation guide for a device according to FIG. 1 mounted so as to be able to move by rotation and translation on one of the plates of the three-axis orthogonal coordinate system.
Figure 8B:
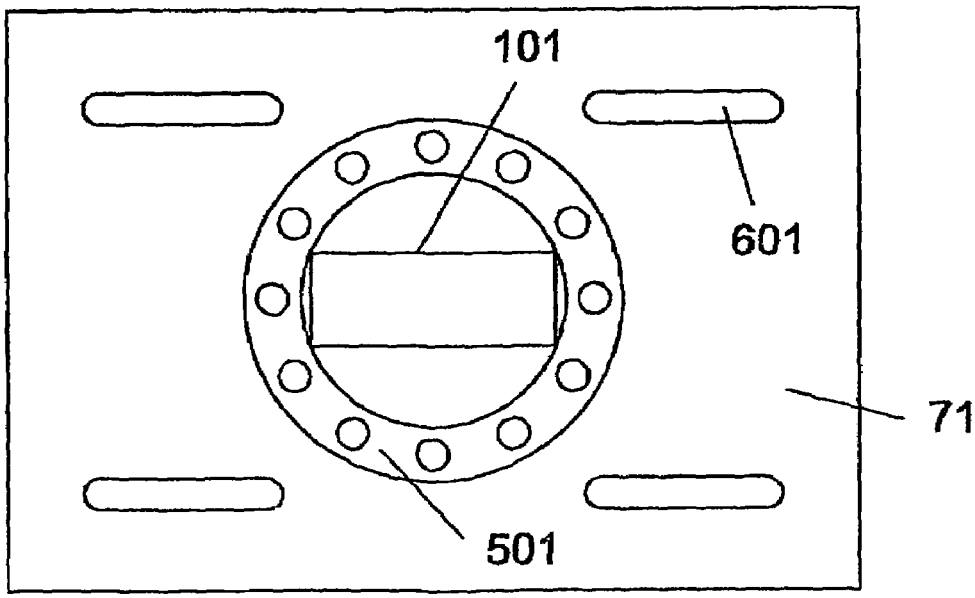

As illustrated by FIGS. 8A and 8B, a propagation guide 101 is removable mounted via a circular flange 801 welded to the propagation guide. The flange 801 has twelve smooth holes arranged in a regular fashion on a circle and is to be fastened by bolts to an intermediate plate 501 having twelve corresponding holes. The intermediate plate also has four slots 601 that receive bolts in order to be fastened in turn to the plate 71 of the three-axis orthogonal coordinate system. The twelve holes in the intermediate plate 501 and in the flange 801 allow the propagation guide 101 to occupy a variable position by rotation about the propagation direction L1 of the guide, the rotation spacing being determined by the angular separation between two successive holes. The slots 601 extend parallel to the plate 71 of the three-axis orthogonal coordinate system so as to allow the propagation guide 101 also to occupy a variable position by translation relative to the plate 71. The position of the three guides can thus be varied by rotation and by translation, while still preserving the positional symmetry of the three guides with respect to the ternary axis of symmetry (Δ) of the coordinate system. It should be noted that that direction of the slots 601 depends in general on the position of the plates 501 relative to the faces 71–73 of the three-axis orthogonal coordinate system.

It is possible to define a complex reflection coefficient R and a complex transmission coefficient T for the generators supplying power to the applicator.

Figure 7:
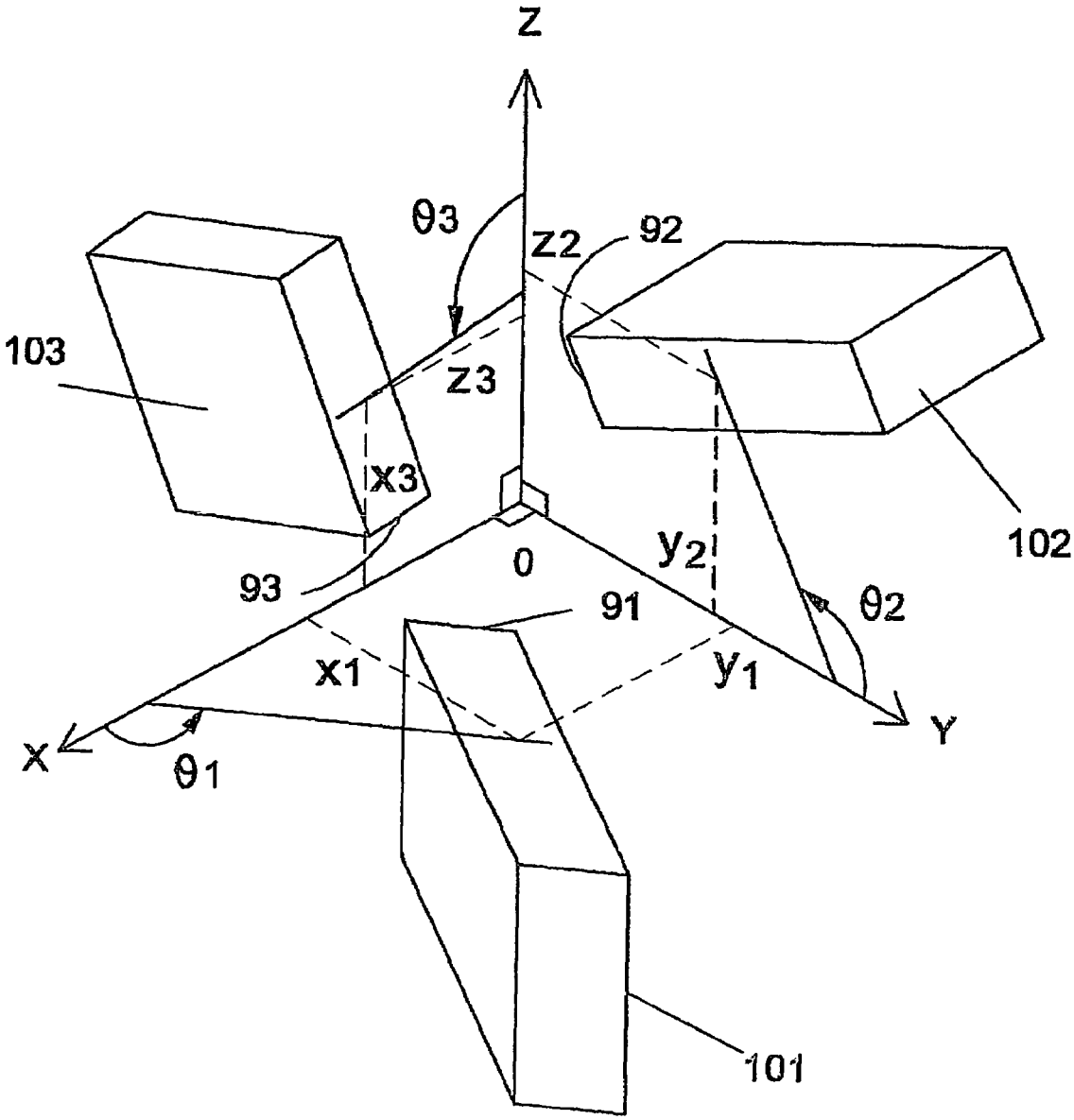
FIG. 7 is a view showing the principle of the three propagation guides of rectangular cross section that are illustrated in FIG. 1, these being mounted so as to move through a rotation about their longitudinal propagation directions and through a translation parallel to the faces of the coordinate system in which they are placed.

Referring to FIG. 7, the coefficients R and T are functions of the coordinates x1, y1 or y2, z2 or z3, x3 of the center of the cross section of each guide, 101, 102 or 103 respectively, which emerges in the applicator, of the angle θ1, θ2 or θ3 that the electric field makes in the plane of the three-axis orthogonal coordinate system on that face of which the propagation guide, 101, 102 or 103 respectively, is placed and from the distance from the object to be treated to the origin O of the coordinate system. The transmission between the propagation guides is made 0 by suitably choosing the three quantities indicated above in order to reestablish decoupling of the three generators. A matcher, known per se and placed in the propagation guide in question, also makes the complex reflection coefficient R seen by each generator 0.

The decoupling of the three generators is quantified by measuring the complex coefficient T with a commercially available network analyzer. The decoupling is acceptable when the modulus of the transfer coefficient T is less than 0.1 so that only 10% of the power emitted by a generator is received by another one. If the transfer coefficient T is greater than 0.1, there is a risk of the generators destroying one another and the energy efficiency of the applicator is poor, the efficiency η of each generator being defined by the power delivered to the product with respect to the emitted power, this having a value $\eta=1-R^2-2T^2$. The reflection coefficient R is also measured using a network analyzer.

In the first, second or third embodiment, the applicator 1 is of circular or triangular cross section.

It should be noted that the electromagnetic field distribution in the object to be treated is determined by the fact that an applicator whose cross section is an equilateral triangle has three fundamental transverse electric propagation modes that have the same cutoff wavelength $\lambda_c=1.5a$. The propagation mode of immediately higher order is a TM mode with $\lambda_c=\frac{1}{2}a\sqrt{3}$ and the next TE mode has for $\lambda_2=\frac{1}{2}a$. Through its symmetry, the three-axis orthogonal coordinate system excites the three fundamental modes. Since these modes are orthogonal, there is no coupling between the modes created on the one hand, and the guides that excite them on the other. The decoupling of the guides remains if the triangular applicator becomes circular.

Three examples of how the invention is applied are described below.

In a first example, the applicator is a reactor for dehydrating a gas, comprising a column of zeolites through which a wet gas flows. During the adsorption phase, the water from the gas is adsorbed by the zeolites. When the zeolites have retained an amount of water corresponding in general to 30% of their weight, the column is purged by irradiating it with the microwave device in order to desorb the water.

The reactor is a cylinder of circular cross section, for example with a diameter of 30 cm. Referring to FIG. 1, a microwave device according to the first embodiment of the invention is used, in which the three propagation guides 101, 102 and 103 of rectangular cross section are mounted respectively on the three faces 71, 72 and 73 of the three-axis orthogonal coordinate system OX, OY, OZ so that the short sides 91, 92 and 93 of their rectangular cross sections remain pairwise orthogonal. The coordinate system lies above the reactor, the ternary axis of symmetry Δ being in alignment with the central axis of the reactor.

Figure 9:
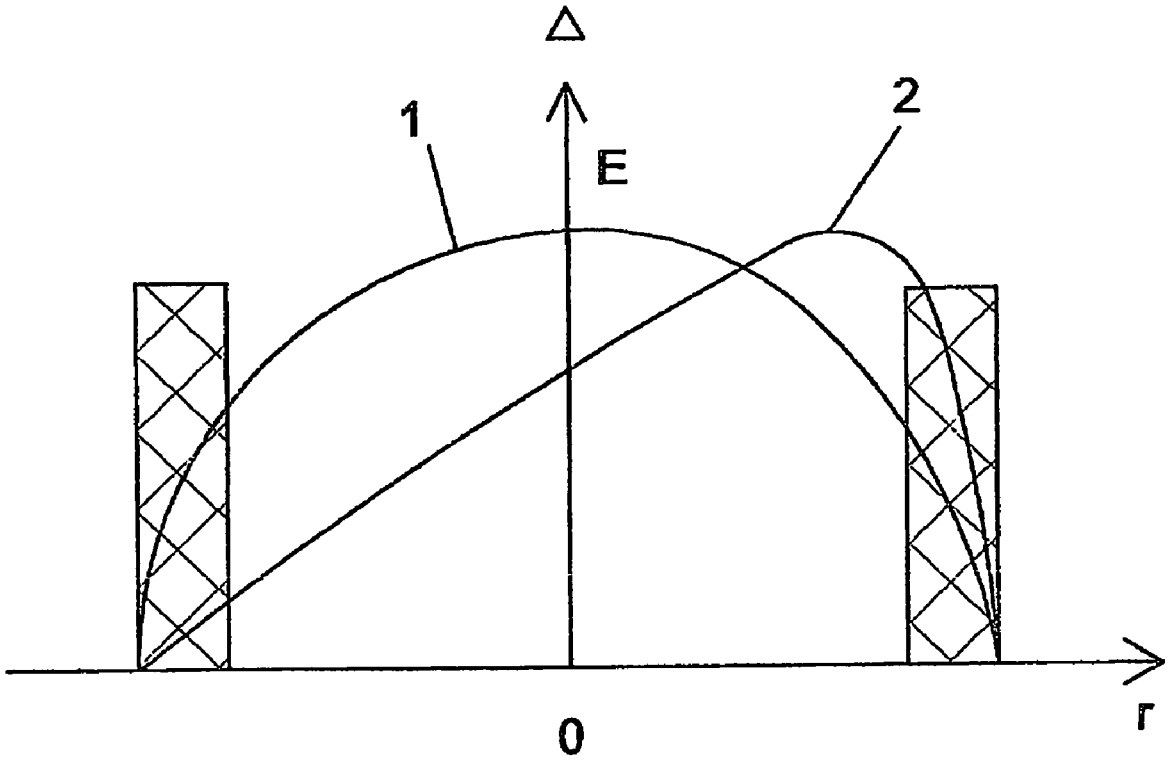
FIG. 9 shows the distribution of the electromagnetic field created by a microwave device according to the first embodiment of the invention, the applicator of circular cross section being a dehydration reactor.

If the transparent windows of the propagation guides are close to the origin O of the coordinate system, the surface of the adsorbent is irradiated shown by curve 1 in FIG. 9. The electromagnetic field has a circular symmetry with a maximum at the centre of the cross section and a minimum near the wall of the reactor. If the transparent windows of the propagation guides are far from the origin O of the coordinate system, the electromagnetic field distribution assumes the appearance of curve 2. It may be seen that, for the diametral plane that passes through a generator, the maximum is offset toward the opening for the generator in question. The decoupling of the three generators allowing the electromagnetic field distributions of each generator to be added according to the squares of the moduli of the electrical fields, results in a more uniform overall distribution.

It should be noted that the microwave device is more advantageously applicable when the energy provided is used essentially to desorb water without heating the zeolites, thereby avoiding having to cool the column before it is reused in order to carry out the adsorption phase.

This example shows that by moving the three generators further away from or closer to the origin O of the coordinate system, the distribution of the electromagnetic field radiated in one section of the applicator is modified, without thereby the generators outputting to one another. It follows that the overall distribution of the energy radiated from the direction of the ternary axis of symmetry of the coordinate system and around the latter can thus be adjusted as required.

The use of the microwave device according to the invention is not limited to the dehydration of zeolites, but also covers any physico-chemical or catalytic operation, such as microwave-stimulated evaporation of a solvent contained in a product or an oil.

In a second example, the applicator is a reactor for burning toxic gaseous components of air and to decontaminate the air, by making the gas flow through a column filled with a catalyst, for example alumina or silica granules on which metals have been coated, for example coated with 0.8% platinum by weight, or with silicon carbide. The applicator comprises a column having a diameter of 1.5 meters and a height of 2 meters. It is supplied with power by three 10 kW generators operating continuously at 915 MHz. It should be pointed out that the air to be treated can flow only along the center of the column, since near the wall of the column, corresponding to the hatched parts shown in FIG. 9, the electric field is of low intensity.

In a third example, the applicator is a glass furnace. Glass workers often wish to preserve glass bases of various colors or various qualities and to use them when they wish to do so.

Figure 10:
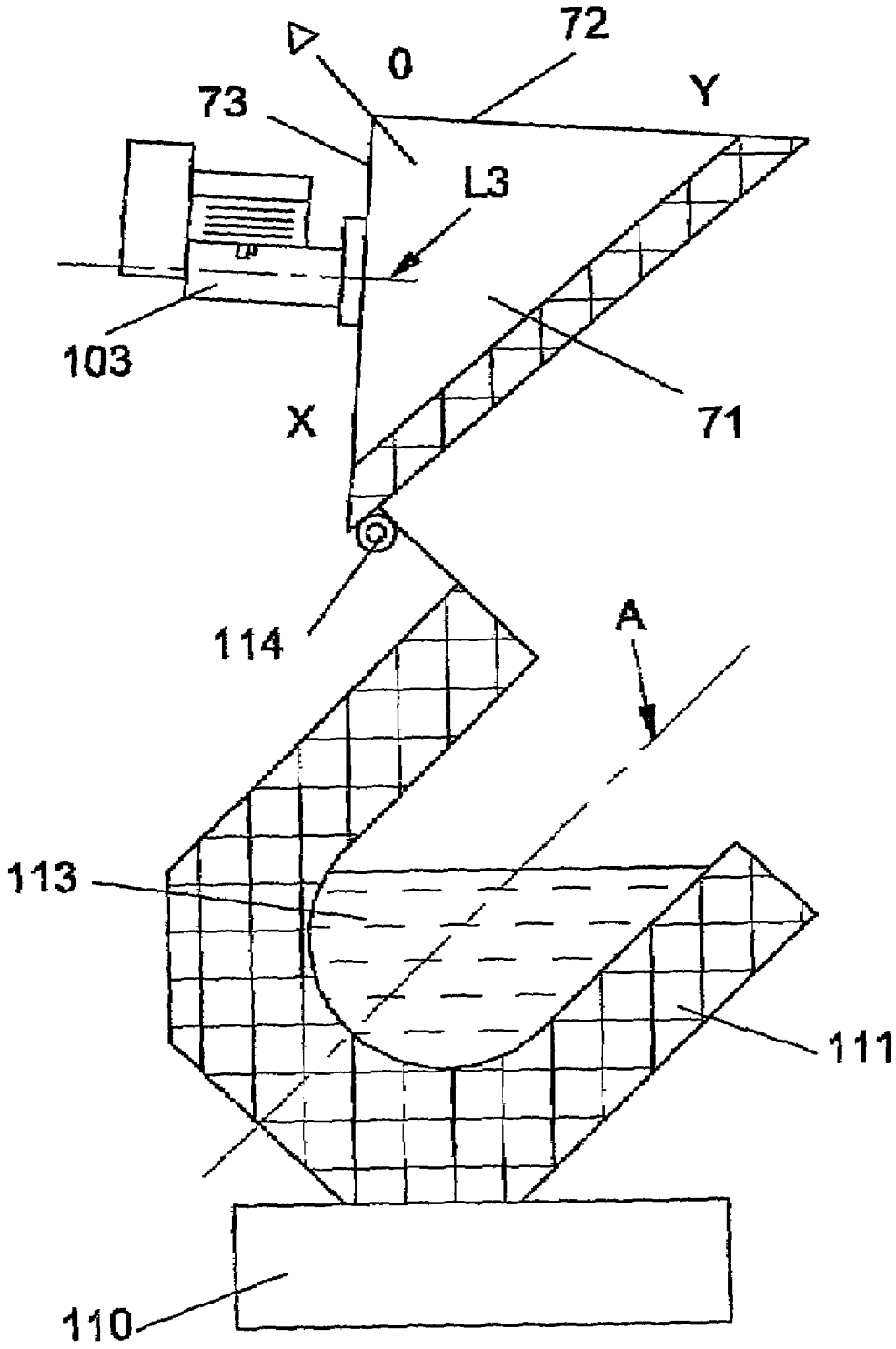
FIG. 10 shows schematically a microwave device according to the first embodiment of the invention in which the applicator is a glass furnace.

The furnace shown in FIG. 10 comprises a cylindrical crucible 111 of circular cross section, made of refractory silica or alumina, mounted so as to pivot on a metal support 110. The crucible may contain several liters of molten glass 113. This is heated by a microwave device according to the first embodiment of the invention. The three-axis orthogonal coordinate system lies above the applicator, with the ternary axis of symmetry Δ aligned with the central axis A of the crucible. The three domestic generators each output a power of 1.2 kW so that the total irradiation power is 3.6 kW. The three-axis orthogonal coordinate system OX, OY, OZ provided with three propagation guides 101, 102 and 103 swing about a hinge 114 in order to allow access to the crucible when the glassmaker comes to collect the molten glass. Obviously, the generators are turned off when the furnace is open.

The power emitted by the magnetrons can be finely adjusted so that the operation of the furnace is very economic. It can be rapidly operated and the crucibles that contain various colors can be changed and stored separately.

It should be noted that a microwave device according to the invention (first or second embodiment) operates for example at a frequency of 915 MHz or 2450 MHz. A radiofrequency device (third or fourth embodiment) operates for example at a frequency of 13.56 MHz or 27.12 MHz.

The invention claimed is:

1. A microwave or radiofrequency device comprising an applicator designed to house an object to be treated and several generators supplying power to the applicator via propagation guides, characterized in that three propagation guides propagating the microwaves or radiofrequency waves generated respectively by three generators are mounted respectively on three plates forming a three-axis orthogonal coordinate system (OX, OY, OZ) and are arranged symmetrically with respect to a ternary axis of symmetry (Δ) of the coordinate system so that the generators supply power to the applicator while being mutually decoupled.

2. The device as claimed in claim 1, wherein the three propagation guides are of rectangular cross section and mounted respectively on the three plates so that the short sides of their rectangular cross section remain pairwise orthogonal.

3. The device as claimed in claim 2, wherein each propagation guide extends along a longitudinal propagation direction perpendicular to the plate on which it is mounted.

4. The device as claimed in claim 3, wherein the three propagation guides emerge in the applicator via microwave-transparent windows formed at one end of each propagation guide.

5. The device as claimed in claim 3, wherein the three propagation guides emerge in the applicator via slots formed on one side of each propagation guide.

6. The device as claimed in claim 2, wherein each propagation guide extends along a longitudinal propagation direction parallel to the plate on which it is mounted.

7. The device as claimed in claim 6, wherein the three propagation guides emerge in the applicator via microwave-transparent windows formed at one end of each propagation guide.

8. The device as claimed in claim 6, wherein the three propagation guides emerge in the applicator via slots formed on one side of each propagation guide.

9. The device as claimed in claim 1, wherein the three propagation guides are coaxial cables that extend along a longitudinal propagation direction perpendicular to the plates and emerge in the applicator via a current loop.

10. The device as claimed in claim 1, wherein the three propagation guides are coaxial cables that extend along a longitudinal propagation direction perpendicular to the plates and emerge in the applicator via one of their stripped ends.

11. The device as claimed in claim 1, wherein the propagation guides occupy a variable position through a rotation about their longitudinal propagation direction and through a translation parallel to the plates on which they are mounted, while preserving the symmetry with respect to the ternary axis of symmetry (Δ) of the coordinate system (OX, OY, OZ) in order to adjust the decoupling of the generators according to the shape of the object housed in the applicator.

12. The device as claimed in claim 1, wherein the applicator is of circular or triangular cross section.

13. The device as claimed in claim 1, wherein the applicator is a chemical reactor or a glass furnace.

* * * * *